US006076709A

United States Patent [19]

Wilner

[11] Patent Number: 6,076,709

[45] Date of Patent: Jun. 20, 2000

[54] DENTAL ADHESIVE CONTAINER DROPPING SYSTEM

[75] Inventor: Ralf Wilner, Bodman-Ludwigshafen, Germany

[73] Assignee: Dentsply DeTrey G.m.b.H., Germany

[21] Appl. No.: 09/072,245

[22] Filed: May 4, 1998

[51] Int. Cl.[7] ..... B65D 47/18; A61M 35/00

[52] U.S. Cl. ..... 222/212; 222/420; 428/36.6

[58] Field of Search ..... 222/420, 421, 222/422, 190, 212, 215; 604/295; 428/36.91, 36.6, 35.7

[56] References Cited

U.S. PATENT DOCUMENTS

| | | | |
|---|---|---|---|
| 3,882,259 | 5/1975 | Nohara et al. | 428/35 |
| 3,908,070 | 9/1975 | Marzolf | 428/474 |
| 4,209,027 | 6/1980 | Morganroth | 132/9 |
| 4,217,161 | 8/1980 | Yamada et al. | 156/242 |
| 4,281,045 | 7/1981 | Sumi et al. | 428/516 |
| 4,355,721 | 10/1982 | Knott, II et al. | 206/524 |
| 4,410,482 | 10/1983 | Subramanian | 264/515 |
| 4,444,817 | 4/1984 | Subramanian | 428/36.6 |
| 4,451,512 | 5/1984 | Yazaki et al. | 428/36 |
| 4,498,609 | 2/1985 | Stock | 222/420 |
| 4,511,610 | 4/1985 | Yazaki et al. | 428/35 |
| 4,572,854 | 2/1986 | Dallmann et al. | 428/35 |
| 4,812,071 | 3/1989 | Batra et al. | 401/264 |
| 4,971,864 | 11/1990 | McCord | 428/516 |
| 5,061,751 | 10/1991 | Patton | 525/57 |
| 5,073,420 | 12/1991 | Yano et al. | 428/355 AC |
| 5,081,164 | 1/1992 | Lai | 522/77 |
| 5,314,733 | 5/1994 | Saito et al. | 428/36.91 |
| 5,330,696 | 7/1994 | Mehra | 264/141 |
| 5,340,228 | 8/1994 | Wilcox et al. | 401/262 |
| 5,372,863 | 12/1994 | Nishikawa | 428/36.6 |
| 5,438,109 | 8/1995 | Nugent, Jr. et al. | 525/526 |
| 5,443,867 | 8/1995 | Mehra et al. | 428/35.7 |
| 5,588,559 | 12/1996 | Vallet Mas et al. | 222/420 X |
| 5,637,410 | 6/1997 | Bonner et al. | 428/36.91 |
| 5,656,346 | 8/1997 | Hirt | 428/36.91 |
| 5,799,837 | 9/1998 | Firestone et al. | 222/420 X |

FOREIGN PATENT DOCUMENTS

| | | |
|---|---|---|
| 0 365 266 | 4/1990 | European Pat. Off. . |
| 0 411 601 | 2/1991 | European Pat. Off. . |
| 431885 | 6/1991 | European Pat. Off. . |
| 0 473 176 | 3/1992 | European Pat. Off. . |
| 0 510 732 | 10/1992 | European Pat. Off. . |
| 0 368 141 | 6/1994 | European Pat. Off. . |
| 197 13 951 | 10/1998 | Germany . |
| WO88/02764 | 4/1988 | WIPO . |
| 98/31742 | 7/1998 | WIPO . |

*Primary Examiner*—Kevin Shaver
*Assistant Examiner*—Eric Keasel
*Attorney, Agent, or Firm*—Douglas J. Hura; James B. Bieber

[57] ABSTRACT

Dental adhesive container dropping system, characterized by the combination of (a) a dental adhesive polymerizable with visible light dissolved in acetone or acetic acid ethyl ester; (b) a light impermeable bottle (1) for the dental-adhesive, elastically deformable for the drop formation, with a laminated wall (3) comprising (b1) at least one polymer layer (15) impermeable to acetone or acetic acid ethyl ester, and (b2) at least one light impermeable, elastically deformable polymer layer (13); (b3) a compatibilizer guaranteeing the laminate structure and which can be formed as at least one intermediate layer (17) or which can be admixed to the elastically deformable polymer layer (13); (c) a light impermeable and evaporation-proofsealable dropper insert (20) of light impermeable plastic material with a dropper conduit (50) enlarging from the inner to the outer part, whereby; (c1) the diameter at the inlet end corresponds to the desired drop size; and, (c2) the diameter at the discharge end is within the range of from 0.1 to 0.25 MM.

3 Claims, 2 Drawing Sheets

DENTAL ADHESIVE CONTAINER DROPPING SYSTEM

The invention relates to a system of a polymerizable dental adhesive, a bottle and a dropper.

In a known system of this kind, the dental adhesive is polymerizable with visible light and contains acetone as a solvent In order to avoid a loss of acetone, a light impermeable glass bottle had to be used as a container. However, this requires the use of a gravitation dropper with a ventilation hole. As a consequence, the dropping frequency is very high and cannot be controlled because of the low viscosity of acetone used as a solvent:. After the application of the first desired drop, the user has to turn around the bottle very quickly, before the next undesired drop can flow out. In practice, this causes great difficulties.

Furthermore, it has already been known to use a plastic bottle for a dental adhesive on acetone basis as well as a dropper insert with a single dropper conduit. There is a considerable loss by acetone diffusion through the bottle wall. For a delimitation of this problem to a certain extent, the bottle wall must be very thick and/or consist of a material which is slightly more diffusion proof and therefore stiffer. Consequently, manual compression of the bottle for controlling the drop formation is difficult. For this reason, a dropper conduit of at least 0.3 mm is provided which has a relatively great lumen. However, this has serious disadvantages. Firstly, the liquid runs out under the mere effect of gravitation. Secondly, the drop frequency cannot be manually controlled. Notably, a second undesired drop can hardly be avoided. Thirdly, the dropper conduit having a great lumen causes the problem of an undesired light incidence. Furthermore, a residual amount of dental adhesive in the battle with the great wall thickness can be recognized by he shaking sound only with difficulties.

It is therefore the problem of the invention to provide a dental adhesive container dropping system wherein on the one hand the dental adhesive polymerizable with visible light may contain acetone as a solvent and wherein on the other hand the drop formation is manually controllable, the running out of further undesired drops is avoidable, and yet the loss by acetone diffusion is avoided to a great extent.

This problem is solved by the dental adhesive container drop system according to claim 1. Preferred embodiments are indicated in the subclaims.

In the following, the invention is explained in detail by means of Figures.

Figure 1:
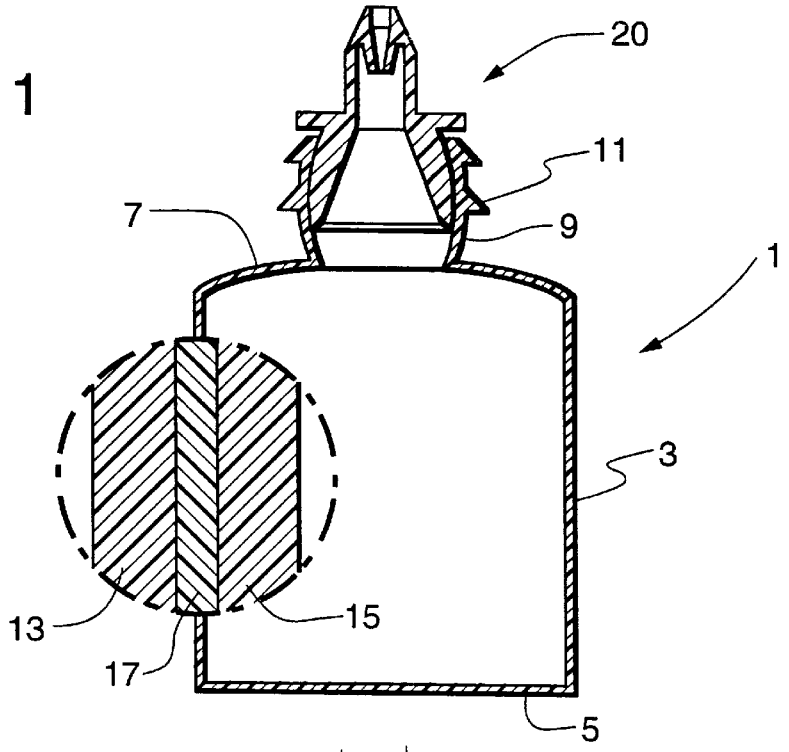
Figure 2:
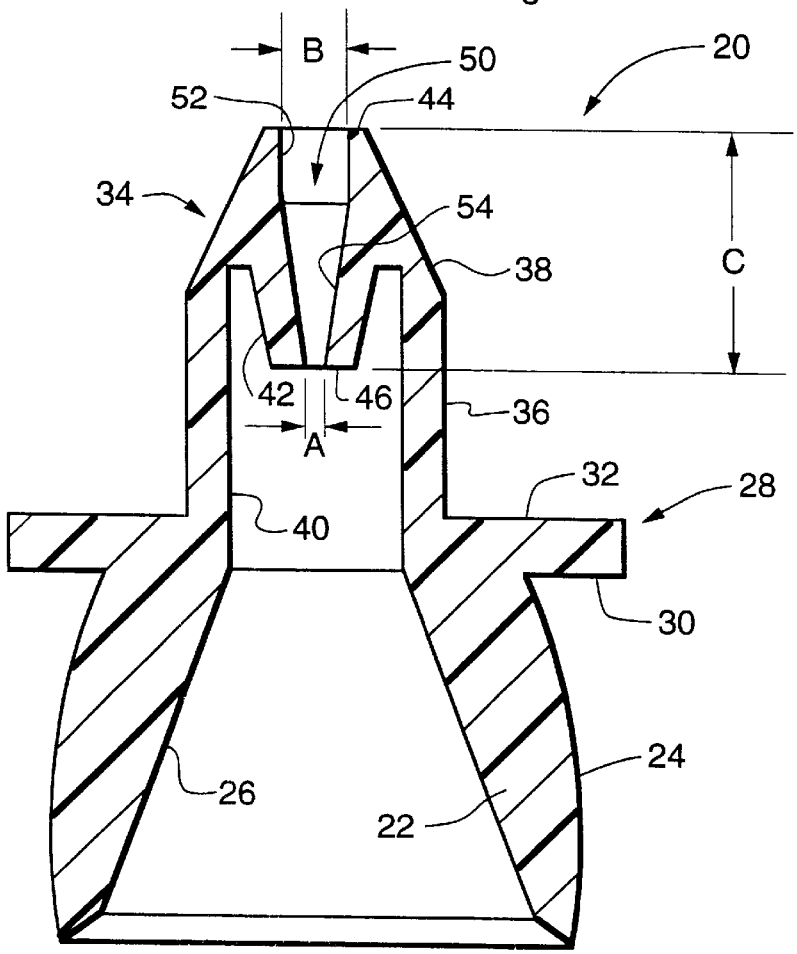
Figure 3:
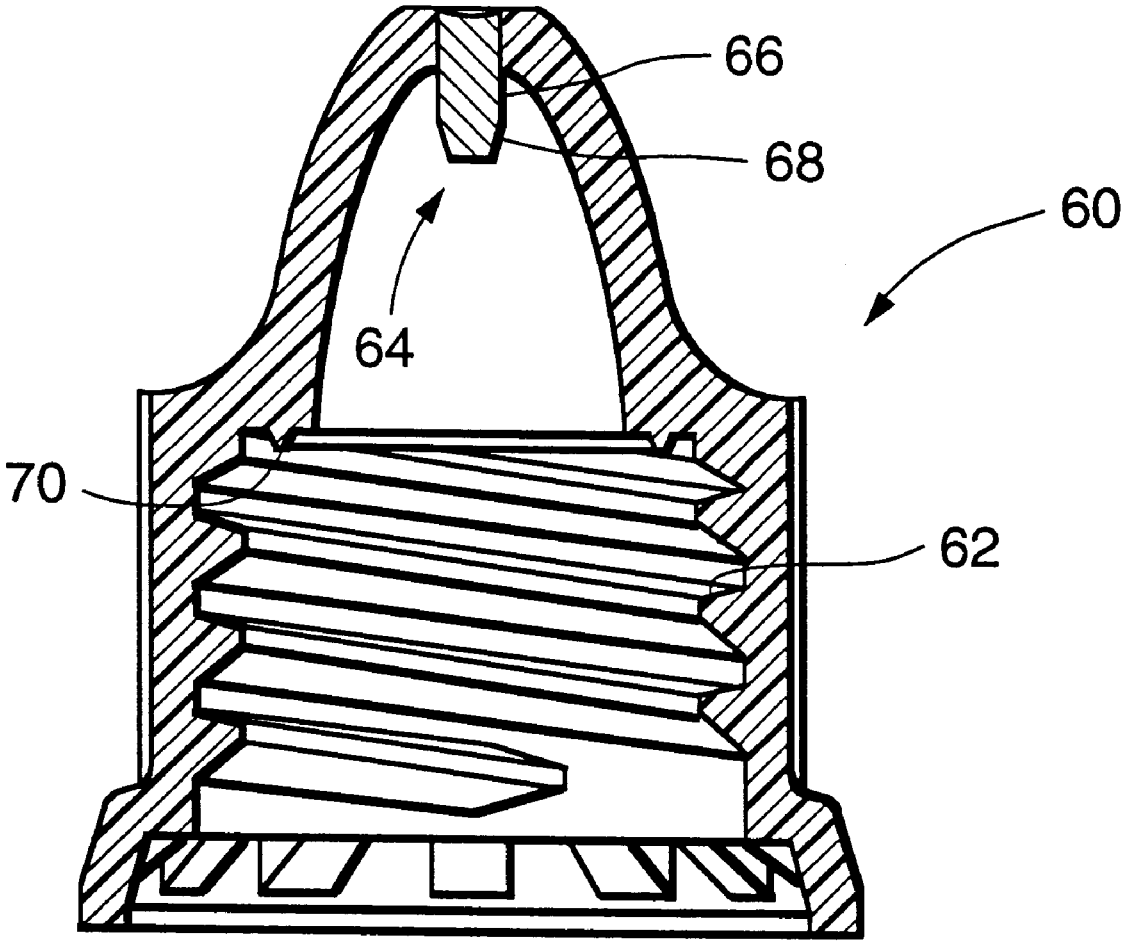

FIG. 1 shows a cross-section of a bottle with dropper insert of the system according to the invention FIG. 2 shows an enlarged cross-section of the dropper insert according to FIG. 1; and FIG. 3 shows a cap for the bottle according to FIG. 1.

FIG. 1 shows a bottle 1 with a cylindrical wall 3, a bottom 5, a shoulder portion 7 and a neck portion 9 with an outer winding 11. A part of the cross-section of the cylindrical wall is enlarged, whereby the laminate structure is shown. An outer wall 13 consists of a light impermeable coloured polyolefin and is self-supporting and elastic. An inner layer 15 consists of a material which is effective as a barrier material against the permeation of acetone vapor. The intermediate layer 17 of compatibilizer guarantees a solid adhesion of the laminate. The bottom 5 and the shoulder portion 7 have the same structure.

Polymers for the outer wall 13 are preferably polyolefines such as polyethylene, polypropylene, polybutylene or polycarbonate. Preferred is polyethylene having a low density (LDPE) or a polyolefine mixture having a content of at least 50% by weight LDPE or a polymer having at least the same elasticity.

Materials for the inner layer 15 are preferably polyamides, polyepoxides, polyesters, polyvinyl alcohol or copolymers or mixtures thereof. Amorphous polyamides such as 6,6-nylon, 6,9-nylon, 6,10-nylon, 6,12-nylon, polycaprolactam are especially suitable as polyamides. Polyglycidylethers of aromatic polyols such as bisphenol A or the like or aliphatic polyols such as 1,2-ethanediol, 1,2-propanediol, 1,3-propanediol, 1,4-butanediol, diethylene glycol, triethylene glycol are especially suitable as polyepoxides. The molecular weight of the polyamides is preferably at least 5,000. The molecular weight of the polyepoxides is at least 2000.

A polyolefine of the above-mentioned nature with polymerized units with carboxylic acid groups, carboxylic acid amide groups or carboxylic acid ester groups is especially suitable as an intermediate layer.

Alternatively, the layer of the above-mentioned nature being effective as a barrier material against acetone vapor can also be provided as an intermediate layer and can be laminated on both sides with identical layers of a mixture of polyolefine and the compatibilizer of the above-mentioned nature.

Preferably, the bottle has an inner volume of from 3 to 10 ml, preferably from 5 to 9 ml. The average wall thickness in the cylindrical portion is preferably from 0.3 to 1.5 mm, specifically from 0.5 to 1 mm and notably from 0.7 to 1 mm.

A one-piece dropper insert 20 of light impermeable polypropylene is inserted into the neck portion 9 of the bottle 1. This dropper insert comprises an insert body 22 with a convex outer surface 24 and an inner surface 26 conically enlarging to the bottom. The insert body is completely inserted into the neck portion 9 of the bottle 1. With the arcuate outer surface 24 it snaps into a correspondingly concave-shaped arcuate inner surface of the neck portion 9 of the bottle 1. Hereby, an increased density against acetone vapor is obtained. A radial flange 28 follows the body 24 at the upper part. Said flange 28 is positioned with a lower surface 30 on the upper rim of the neck portion 9 of the bottle 1. An upper surface 32 of the flange is effective as a closing surface for a below-described stopper. At the upper part, a flange 28 is followed by a nozzle body 34 which has a cylindrical lower outer surface 36 and an upper surface 38 which is truncated-cone-shaped. An inner cylindrical surface 40 extends up to the conical portion. A further truncated-cone-shaped portion 42 extends in the inner part of the nozzle body downwards. The nozzle body 34 has an upper border by a laminated surface 44, and the portion 42 has a lower border by a laminated surface 46. A dropper conduit 50 extends from the laminated surface 44 to the laminated surface 46. The dropper conduit 50 has an upper cylindrical portion 52 and a lower portion 54 conically enlarging from the bottom to the top. The length C of the dropper conduit 50 is preferably 3 to 18 mm, notably from 4 to 10 mm and especially from 5 to 8 mm. The diameter B at the discharge end of the dropper conduit 50 is preferably 0.8 to 2.5 mm, notably 1.0 to 2.0 mm and especially 1.2 to 1.6 mm. It determines the desired size of the drops formed. The smallest diameter A of the inlet end of the dropper conduit 50 is 0.1 to 0.25 mm, preferably 0.1 to 0.15 mm and especially 0.12 to 0.14 mm. It determines the passage rate of the dental adhesive.

A cap 60 cross-sectionally shown in FIG. 3 of black polypropylene shows an inner winding 62. An inner projection 64 with an upper cylindrical portion 66 and a lower conical portion 68 engages in a sealing manner into dropper conduit 50. Further, a torus 70 is provided, which interacts in a sealing manner with the upper surface 32 of the flange 28.

What is claimed is:

1. Dental adhesive container dropping system, characterized by the combination of (a) a dental adhesive polymerizable with visible light dissolved in acetone or acetic acid ethyl ester, (b) a light impermeable bottle (1) for the dental adhesive, elastically deformable for the drop formation, with a laminated wall (3) comprising (b1) at least one polymer layer (15) impermeable to acetone or acetic acid ethyl ester, and (b2) at least one light impermeable, elastically deformable polymer layer (13), (b3) a compatibilizer guaranteeing the laminate structure and which can be formed as at least one intermediate layer (17) or which can be admixed to the elastically deformable polymer layer (13), (c) a light impermeable and evaporation-proof sealable dropper insert (20) of light impermeable plastic material with a dropper conduit (50) enlarging from the inner to the outer part, whereby (c1) the diameter at the inlet end corresponds to the desired drop size and (c2) the diameter at the discharge end is within the range of from 0.1 to 0.25 mm.

2. Dental adhesive container dropping system according to claim 1, characterized in that the bottle has an inner volume of from 3 to 10 ml.

3. Dental adhesive container dropping system according to one of claims 1 or 2, characterized in that the bottle (1) has a wall thickness of from 0.3 to 1.5 mm.

* * * * *